US006722309B1

(12) United States Patent
Ben-Dor et al.

(10) Patent No.: US 6,722,309 B1
(45) Date of Patent: Apr. 20, 2004

(54) BOOKMARK

(76) Inventors: Eran Ben-Dor, 10 Uziel Street, Ramat Gan (IL); Eran Conforty, 14B Harugey Malchut St., Tel Aviv (IL)

( * ) Notice: Subject to any disclaimer, the term of this patent is extended or adjusted under 35 U.S.C. 154(b) by 0 days.

(21) Appl. No.: 09/612,570

(22) Filed: Jul. 7, 2000

(30) Foreign Application Priority Data

Jul. 8, 1999 (IL) ..... 130866

(51) Int. Cl.[7] ..... B42D 9/00
(52) U.S. Cl. ..... 116/234; 116/238; 281/42
(58) Field of Search ..... 116/234, 237, 116/238, 239; D19/34; 281/42

(56) References Cited

U.S. PATENT DOCUMENTS

| | | | | | |
|---|---|---|---|---|---|
| 1,346,729 | A | * | 7/1920 | Vanderveer | 116/234 |
| 1,468,685 | A | * | 9/1923 | Wise | 116/234 |
| 1,919,971 | A | * | 7/1933 | Wulkop | 116/234 |
| 1,961,527 | A | * | 6/1934 | Petro | 116/238 |
| 2,282,939 | A | * | 5/1942 | Clawson | 116/234 |
| D135,551 | S | * | 4/1943 | Scott | D19/34 |
| 2,438,048 | A | * | 3/1948 | Graham | 116/238 |
| 2,576,783 | A | | 11/1951 | Dewey | |
| 2,861,309 | A | * | 11/1958 | Saviolides | 116/238 |
| 3,158,131 | A | * | 11/1964 | Salayka | 116/237 |
| D211,924 | S | * | 8/1968 | Margeson | D19/34 |
| D223,694 | S | * | 5/1972 | McKenna | D19/34 |
| 4,243,338 | A | * | 1/1981 | Williams | 116/234 |
| 4,335,903 | A | * | 6/1982 | Collins et al. | 281/42 |
| D271,888 | S | * | 12/1983 | Dolas | D19/34 |
| 4,465,232 | A | * | 8/1984 | Field | 116/234 |
| D281,982 | S | * | 12/1985 | Hammond | D19/34 |
| 4,569,538 | A | * | 2/1986 | Kurschner | 116/235 |
| 4,721,057 | A | * | 1/1988 | Vigil | 116/238 |
| D297,334 | S | * | 8/1988 | Trent | D19/34 |
| D313,627 | S | * | 1/1991 | Diaz | D19/34 |
| 5,095,846 | A | | 3/1992 | Knight | |
| 5,325,811 | A | | 7/1994 | Miroyan | |
| 5,359,793 | A | * | 11/1994 | Copperstone | 281/42 |
| 5,375,884 | A | | 12/1994 | Farrington | |
| D355,933 | S | | 2/1995 | Collins | |
| 5,437,240 | A | | 8/1995 | Miroyan | |
| 5,462,006 | A | * | 10/1995 | Thiruppathi | 116/234 |
| 5,462,007 | A | | 10/1995 | Prescott | |
| 6,015,166 | A | * | 1/2000 | May | 281/42 |

FOREIGN PATENT DOCUMENTS

| | | | | |
|---|---|---|---|---|
| AU | 718635 B | * | 4/2000 | B42D/9/00 |
| CA | 2297533 A1 | * | 8/2001 | B42D/9/00 |

OTHER PUBLICATIONS

"Butterfly Bookmark", Current Catalog, Aug. 1986, Item 287.*

* cited by examiner

*Primary Examiner*—Diego Gutierrez
*Assistant Examiner*—Lydia M. De Jesús

(57) ABSTRACT

The present invention relates to a bookmark for finding a desired page of a multi-page readable item such as a book or magazine having a plurality of pages bound along inner edges thereof, and disposed between opposed covers, said bookmark having a planar elongated section terminating at an upper curved hook-like extremity configured to extend, when said bookmark is in use, from said bound inner edges over the back of said readable item, an inner edge of an outer leg extension connected to said curved section said inner edge is substantially parallel to said inner edge of said elongated section. The present invention also relates to a second use of a bookmark as a coupon and/or a greeting card, to an advertising device comprising such a bookmark, and to a method for advertising such a bookmark.

8 Claims, 6 Drawing Sheets

BOOKMARK

FIELD OF THE INVENTION

The present invention relates to a bookmark.

More particularly, the invention provides a bookmark which can be used for journals, magazines, books or any other bound collection of papers, and which could also be used for advertising purposes.

BACKGROUND OF THE INVENTION

Bookmarks have been in use for centuries, and if the sole purpose is to find a page in the specific bound collection of pages, any thin flat object will serve this purpose. There is no doubt about the need for a bookmark, several are likely to be found in any average home, schoolbag, office and study hall. Various kinds of bookmarks are described in Art. Some are configured for beauty—small works of art pressed dried flowers held in a thin transparent holder, historical or religious symbols or figures or similar items of attractive appearance, etc.

Another approach is to provide information useful to the book readers for example mathematical formulae, language aids, important telephone numbers, and preferably offering choices to suit the needs of a variety of users.

A third approach is to form a bookmark providing some additional service, for example a line mark, mirror, book closure band, a holder for a pen or pencil, magnifying glass page holder or a light.

The following US Patents give a general picture of the state of the art.

Knight discloses a multi-purpose bookmark in U.S. Pat. No. 5,095,846, which has an inner and outer leg. Resiliently between said legs a spirally wound section on the outer leg provides the friction to keep the mark in place. Page position may be marked by lines extending through an opening in the sector connecting the legs A pen/pencil holder is included.

Miroyan in U.S. Pat. No. 5,325,811 also includes a line marker An elongated planar body having an upper terminal portion provides a surface for decorative and whimsical designs, each including a dominant design element. A finger-engaging indicator matches the dominant design and is movable along a slit for line marking. In U.S. Pat. No. 5,437,240 Miroyan proposes that the indicator piece corresponds in size and shape with the dominant design.

A one piece flexible plastic bookmark is described by Farrington in U.S. Pat. No. 5,375,884. An attachment portion such as a U clip fits over the spine and binding. A long narrow portion is for marking, A bendable thin thread section joins the two portions.

Prescott uses two interconnected bands to hold the marker member disclosed in U.S. Pat. No. 5,462,007. Both the mounting band and the positioning band can be resiliently deformed in combination with the bands the marker member can hold the marked page to the book cover.

Bearing in mind this state of the art, it is now one of the objects of the present invention to overcome the economic difficulties in the marketing of bookmarks by formulating this item in a manner particularly suitable for advertising purposes.

SUMMARY OF THE INVENTION

The present invention relates to a bookmark for finding a desired page of a multi-page readable item, such as a book or magazine, having a plurality of pages bound along inner margins thereof, and disposed between opposed covers. The bookmark has a planar elongated section terminating at an upper curved hook-like extremity configured to extend, when the bookmark is in use, from the bound inner margins over the spine of the readable item. The inner edge of the outer leg extension is substantially parallel to the inner edge of the elongated section below the hook-like extremity and a gap of decreasing width is formed therebetween causing the bookmark to lock onto the pages it rides over.

According to one embodiment said outer leg extension carries an attention-attracting item.

In a further embodiment of the present invention there is provided a bookmark wherein said attention-attracting item is substantially planar and disposed on a plane perpendicular to said elongated section.

In a further embodiment said attention-attracting device is 3-dimensional.

In a further embodiment of the present invention there is provided a bookmark that is adapted to absorb or carry a smelling medium.

In a further embodiment of the present invention there is provided a bookmark that is adapted to carry one or more photographs.

In a further embodiment of the present invention there is provided a bookmark that is a coupon, or is adjacent to a coupon.

In a further embodiment of the present invention there is provided a bookmark that is suitable to be used as a greeting card, or is adjacent to a greeting card.

In a further embodiment of the present invention there is provided a method and an advertising and promotion device, wherein the bookmark is configured so that said attention-attracting item is a first part of an advertising message, and a second portion of said message appears on the inner section and on the elongated section. Such split advertising and promotion method could be implemented in a variety of configurations.

In a further embodiment of the present invention, there is provided a bookmark which is entirely or partially made of a suitable candy substance.

Yet further embodiments of the invention will be described hereinafter.

It will thus be realized that the bookmark of the present invention may arouse curiosity by display of its outer portion, which can be shaped and colored to represent some manufactured product such as for example a camera, watch or soft drink. On opening the journal or book for further viewing of the bookmark, a short text or visual message or a combination of both, with a possible further illustration, gives further information about the product.

The invention will now be described further with reference to the accompanying drawings, which represent by example embodiments of the invention. Structural details are shown only as far as necessary for a fundamental understanding thereof. The described examples, together with the drawings, will make apparent to those skilled in the art how further forms of the invention may be realized.

DETAILED DESCRIPTION OF THE INVENTION

Turning first to FIG. I which depicts in a schematic manner the bookmark where the bold line relates to the functional part of the bookmark while the broken line relates to the contour line which may vary according to customer or designers request. As can be seen the bookmark (1) has an upper hook-like section (3) and a lower section (5). Lower part (5) is held within the book while the upper part rides over the binding. The bold line shown in FIG. 1 delineates a gap of decreasing width such that the bookmark locks on any thickness of the pages it rides over.

Figure 2:
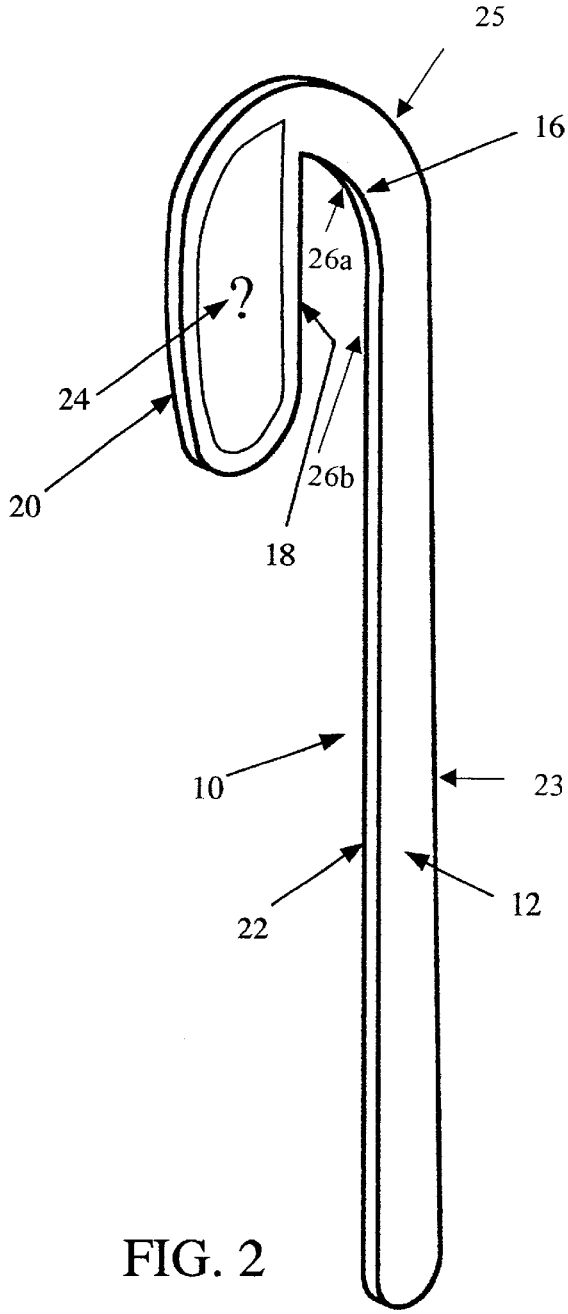
FIG. 2 is a perspective view of a preferred embodiment of the bookmark according to the invention.

Turning now to FIG. 2 where a bookmark (10) particularly suitable for advertising purposes, for finding a desired page of a multi-page item such as a book, journal, album or magazine (not shown) having a plurality of pages bound along inner edges thereof, and disposed between opposed covers.

The bookmark has a planar elongated section (12) terminating at a lower extremity in an inner section; these sections are held between the pages when the bookmark is in use. Said planar elongated section has an outer edge (23) and inner edge (22) that is straight, as illustrated in FIG. 2.

At the upper extremity of the planar elongated section (12) a curved section (16) is configured to extend in a hook-like manner from the bound inner edges over the back of the readable item. Said curved section has an outer curved edge (25) and an inner edge having an upper curved portion **(26*a*) and a lower straight portion (26*b*) that is integral with the inner straight edge (22) of the planar elongated section as illustrated in FIG. 2**.

An inner edge (18) of an outer leg extension (20) is connected to the curved section (16) being substantially parallel to the inner edge (22) of the elongated section (12) and to the lower portion **(26*b*) of the inner edge of the hook-like extremity (16). The outer leg extension (20) could be or could carry an attention-attracting item (24). The gap formed between the outer leg extension and the hook-like extremity, delineated by a bold line shown in FIG. 1**, decreases in width as said curved portion of the inner edge of the hook-like extremity reaches an apex whereat it is joined with said inner edge of the outer leg extension, such that when said planar elongated section is placed between the pages of the readable item, said upper curved hook-like extremity extends over the spine of the readable item such that said outer leg extension and said first portion of said attention-attracting item are external to the readable item and the spine of the readable item extends into said gap up to a width such that said curved extremity locks onto the spine of the readable item to thereby lock the bookmark in place during use.

In the present figure the attention-attracting item (24) is pictorial and is co-planar with the elongated section (12). Alternatively, attention-attracting item (24) may include written text, and be provided as a greeting card, advertisement or coupon, by way of example.

Suitably the bookmark (10) can be manufactured by being punched in one piece from a sheet of cardboard faced on both sides with a printed high gloss paper or any other suitable material. Alternatively, bookmark (10) may be formed from a suitable candy substance.

With reference to the rest of the figures, similar reference numerals have been used to identify similar parts.

Figure 3:
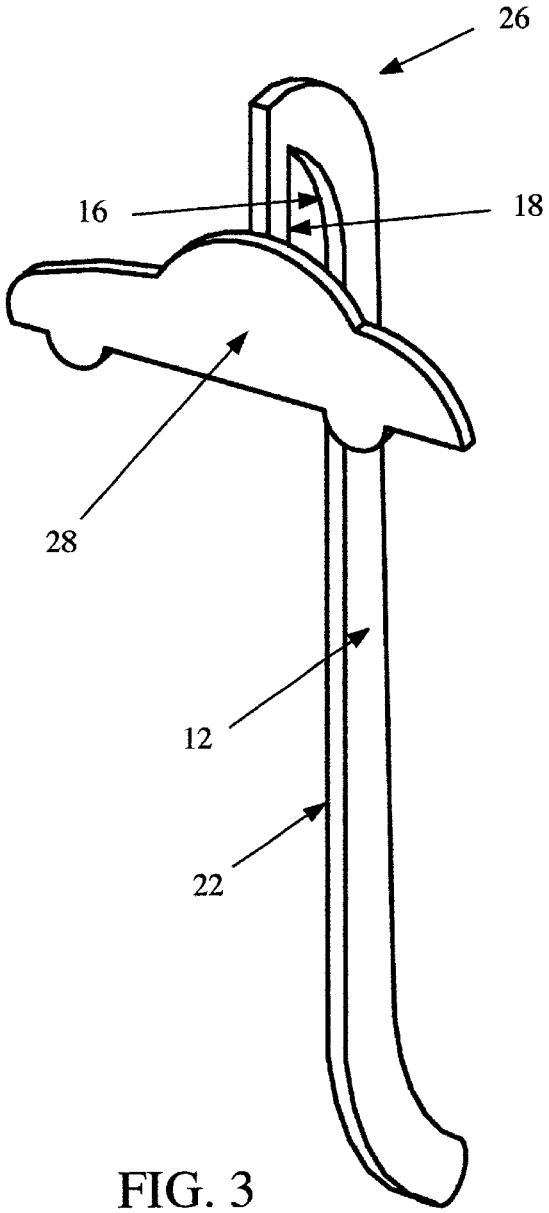
FIG. 3 is a perspective view of an embodiment wherein the attention-attracting item is in a plane perpendicular to the elongated portion.

Referring now to FIG. 3 there is seen a bookmark (26) wherein the attention-attracting item (28), shown as an automobile, is substantially planar and disposed on a plane perpendicular to the elongated section (12). The present embodiment (28) is molded in one or more pieces from plastic or any other suitable material. Alternatively, attention-attracting item (28) may be formed from a suitable candy substance.

Figure 4:
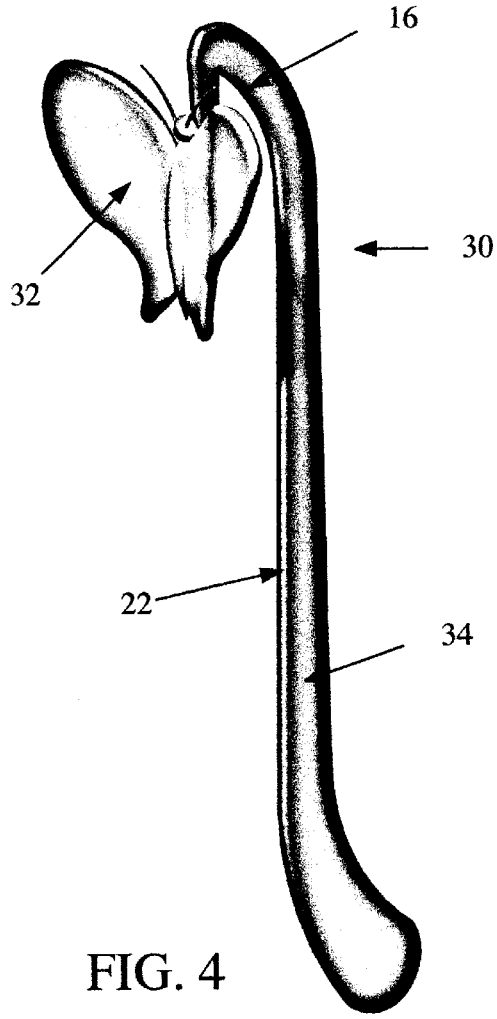
FIG. 4 is a perspective view of an embodiment wherein the attention-attracting item is three dimensional.

FIG. 4 illustrates a bookmark (30) wherein the attention-attracting item (32), here shown as a butterfly, has a three dimensional form. The item (32) and the planar body (34) of the bookmark shown can be molded in one piece or separately from a thermoplastic or any other suitable material and joined by any known or conventional means. The 3-dimensional item could also be a useful item such as magnifying glass or pencil sharpener and the like. Likewise, the inner part could be used as a useful item.

Figure 1:
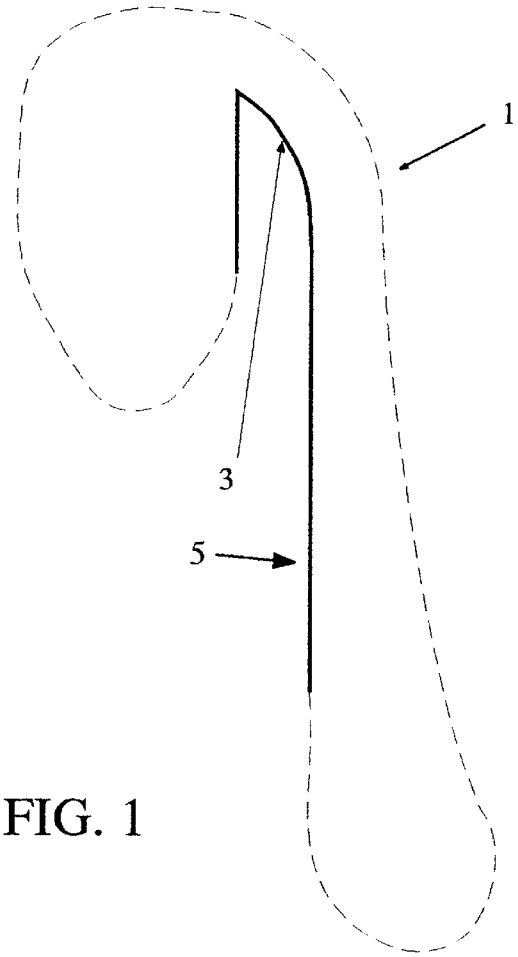
FIG. 1 is a schematic illustration of the bookmark according to the invention.
Figure 5:
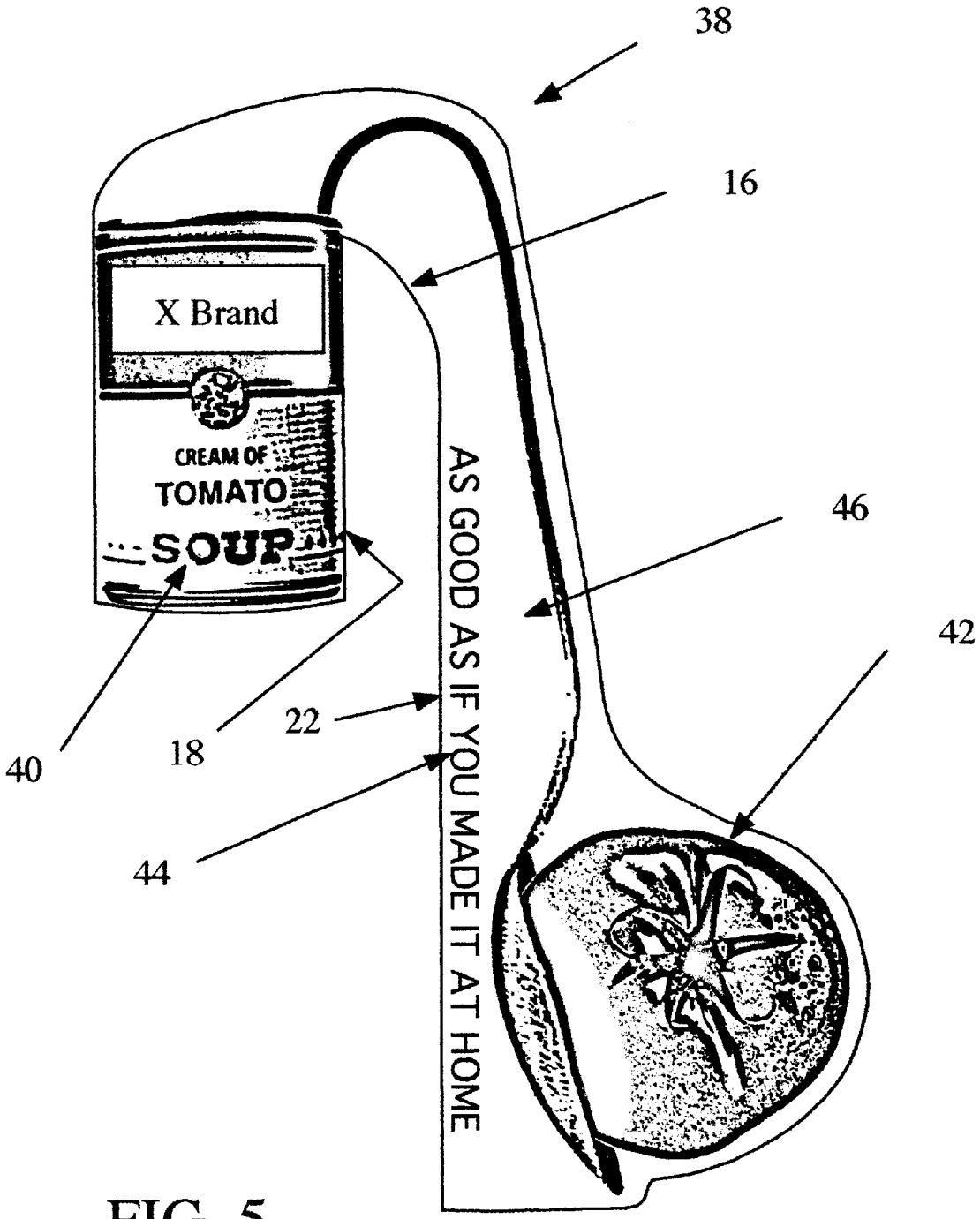
FIG. 5 is an elevation view of the bookmark as an advertising device.

Seen in FIG. 5 is an advertising device (38) similar to the embodiment of FIG. 1 wherein the bookmark is configured so that the attention-attracting item (40) is a first part of an advertising message, in the present embodiment a can of tomato soup. A second portion of the message, here a picture of a tomato appears on the inner section (42) and connecting text (44) on the elongated section (46). Similarly, a greeting card can be incorporated into attention-attracting item (40), inner section (42) and connecting text (44) on the elongated section (46).

Figure 6:
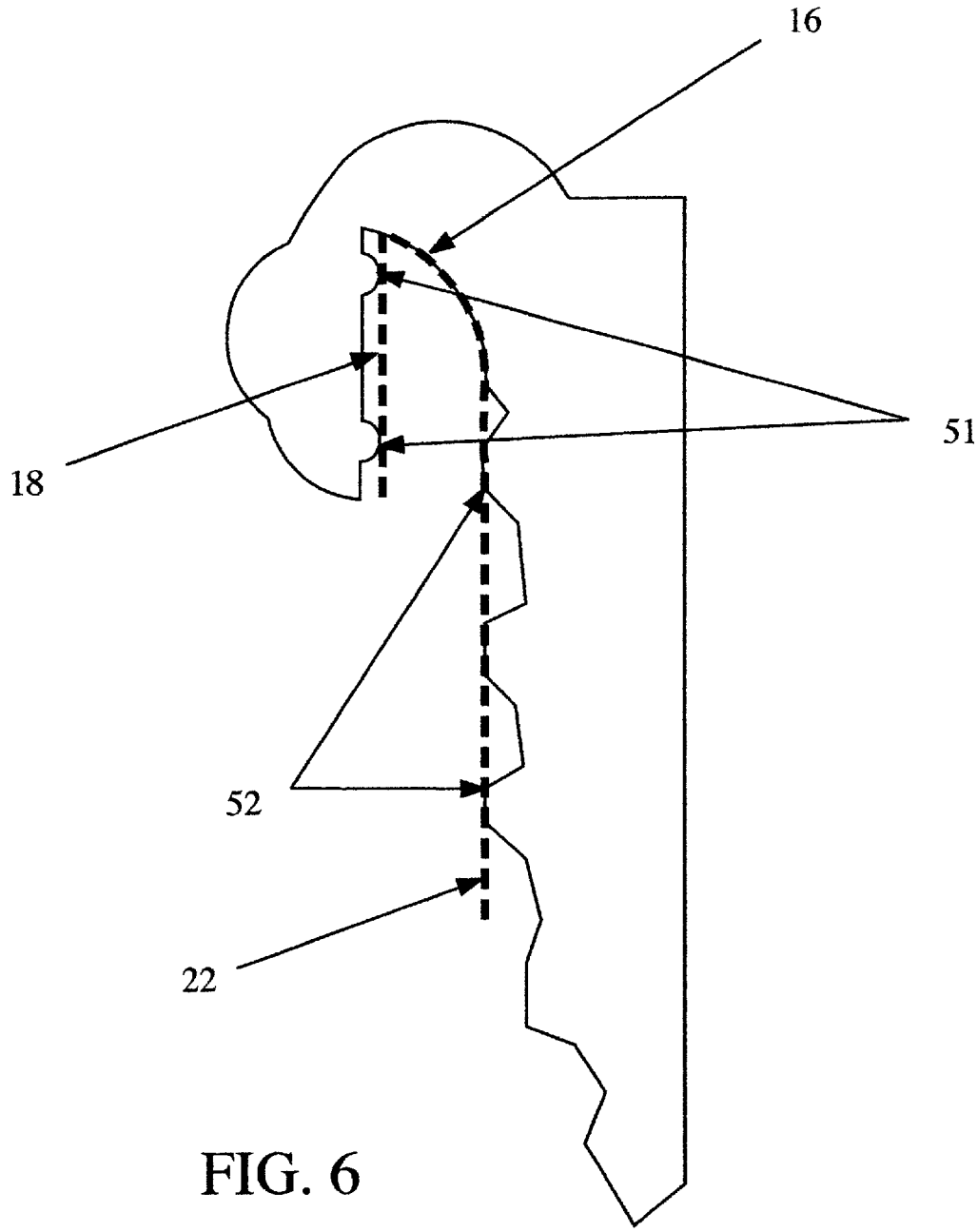
FIG. 6 is a further schematically illustration of the bookmark.

FIG. 6 illustrates a further schematic embodiment where the inner contour edge lines are of a non straight line but of a broken or curved contour line having at least two projections (51) and (52) on each edge which are in line with the full inner contour edge (18) and (22). No projection should exceed the inner contour line (18) and (22) so as to enable proper function of the bookmark.

Figure 7:
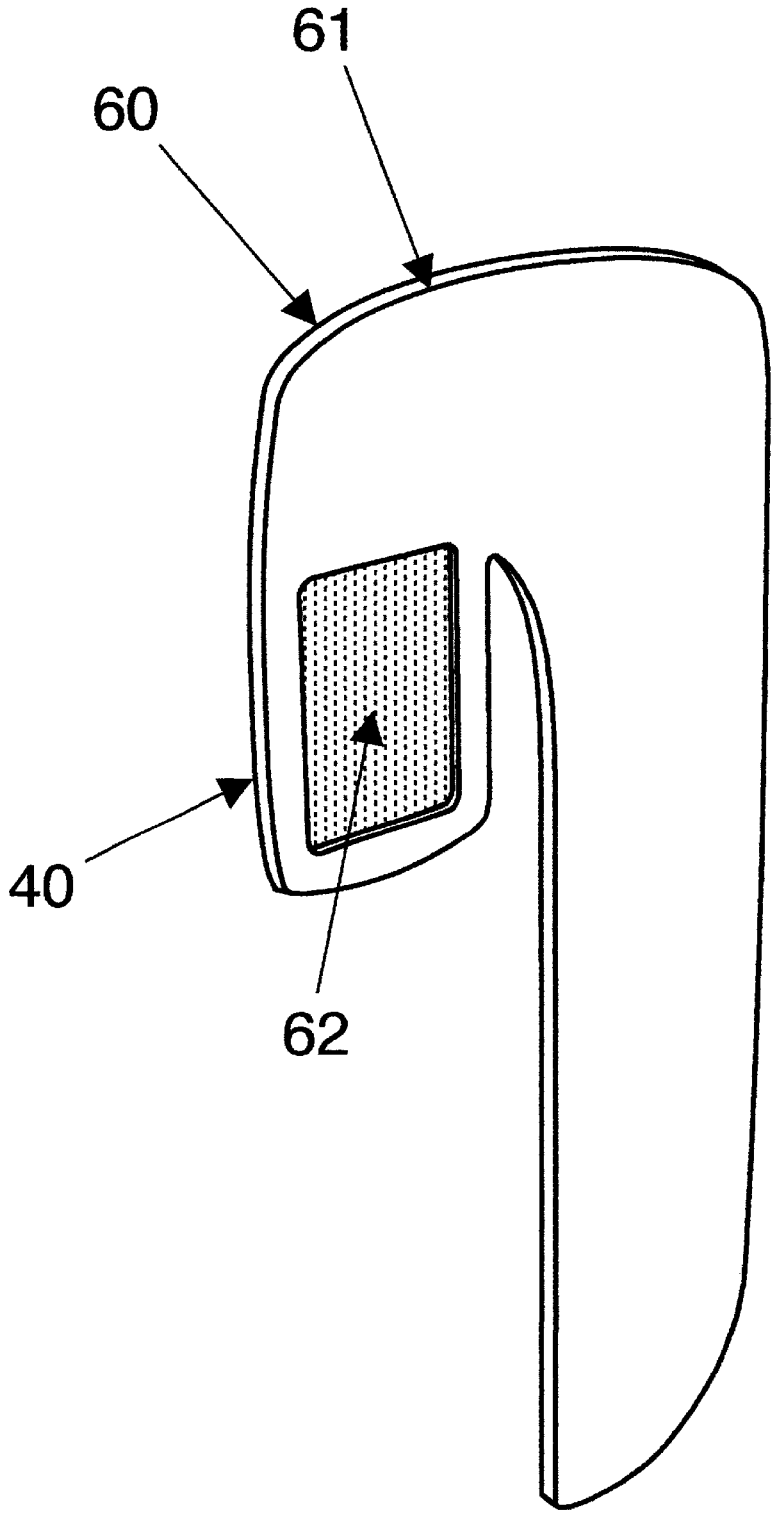
FIG. 7 is a further schematically illustration of the bookmark, which is also used as a photograph holder.

FIG. 7 represents a further embodiment of the present invention in which the attention attracting item (40) is adopted to carry a photograph. According to the present embodiment, the bookmark is made of two layers of cardboard (60) and (61) having the general shape of the final bookmark. One of the cardboard layers (61) has a window-like opening (62) suitable for a photograph to be displayed therein. The photograph is placed in the place of the window-like opening said opening functioning as a frame to said photograph and the two cardboard layers are adhered in alignment to one another, such that the photograph can be seen through the window -like opening of the final product.

Figure 8:
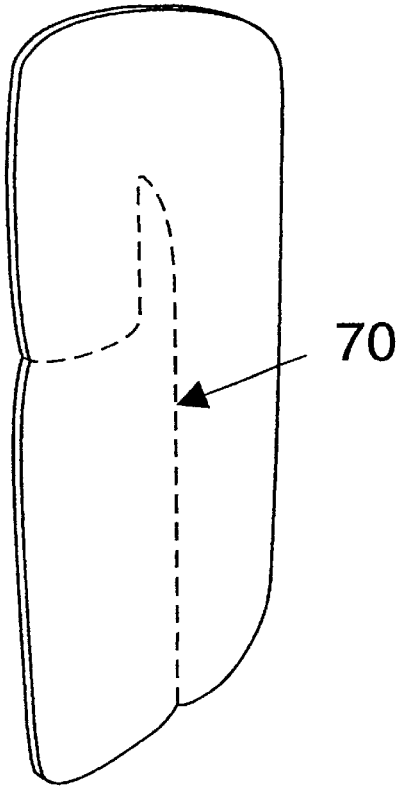
FIG. 8 is a further schematically illustration of the bookmark which can be cut out from a common shaped sheet.

FIG. 8 represents a bookmark according to the present invention in which at a first stage the product is not of the unique functional shape of the present invention, as described in FIG. 1. A line defining the unique functional shape of the present invention may be marked on one or both sides of the cardboard (70) so the potential user may cut along said line and form the bookmark of the present invention and a card (72). Alternatively, the line (70) defining the unique functional shape of the present invention may be in the form of a sequence of holes which will enable the user to easily tear the cardboard sheet in the desired shape of the bookmark and card (72) of the present invention.

Thus, the present invention relates to sheet made of material appropriate to serve as a bookmark such as cardboard or printed high gloss paper, which comprises a teaching to cut, tear, carve or manipulate in any other way, said sheet to result as a bookmark having the unique shape of the present invention. Said teaching may be in the form of a marking of a line that one may cut along or holes that one may tear along.

Figure 9:
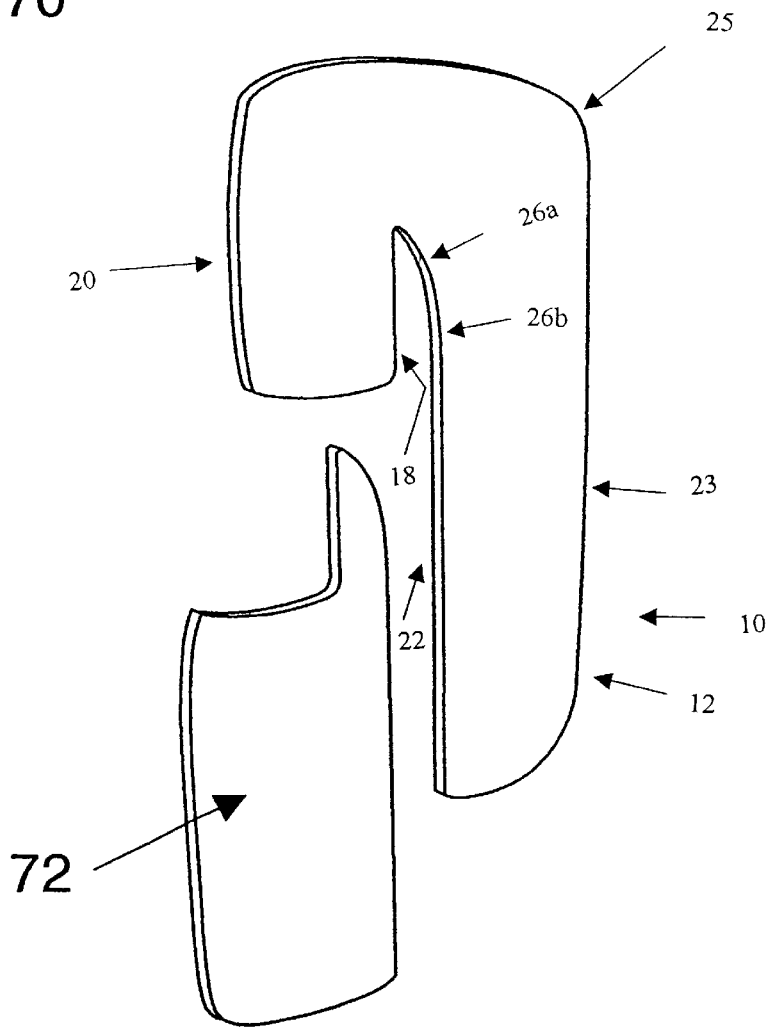
FIG. 9 is a further schematically illustration of the bookmark in which there is a use for the remainder part of the sheet cut out from the original common shaped sheet.

The remainder sheet of cardboard as drawn in FIG. 9, subsequent to it being detached from the bookmark, forms a card (72) with a tab, which may be used for various purposes, such as a greeting card or a business card, or can be recognized by an interested marketing entity as a coupon that may grant its holder some benefit such as a discount of a free or reduced priced product or service.

According to another embodiment the present invention relates to a bookmark having the unique hook-like shape as described above which is also a greeting card.

According to another embodiment the present invention relates to a bookmark having the unique hook-like shape as described above which is connected to a greeting card and can easily be detached therefrom.

According to another embodiment, the present invention relates to a bookmark, which is also a greeting card.

The scope of the described invention is intended to include all embodiments coming within the meaning of the following claims. The foregoing examples illustrate useful forms of the invention, but are not to be considered as limiting its scope as those skilled in the art will readily be aware that additional variants and modifications of the invention can be formulated without departing from the meaning of the following claims.

We claim:

1. A sheet enabling formation of a bookmark for finding a desired page of a multi-page readable item having plurality of pages bound along a spine thereof, and disposed between opposed covers, said sheet comprising:

a teaching to manipulate said sheet to result in the formation of a bookmark and a card, said sheet comprising an attention-attracting item, such that upon manipulation of said sheet said attention-attracting item forms a first and a second portion, said bookmark comprising:

a planar elongated section terminating at an upper curved hook-like extremity, said planar elongated section having an outer edge and an inner straight edge extending below said hook-like extremity, and said hook-like extremity having an outer curved edge and an inner edge having an upper curved portion and a lower straight portion integral with the inner straight edge of the planar elongated section; and an outer leg extension formed integrally with said curved extremity, said outer leg extension having an inner straight edge being substantially parallel to said inner edge of the planar elongated section and to the straight portion of the inner edge of the hook-like extremity, said curved extremity providing a gap between said inner edge of the hook-like extremity and said inner edge of the outer leg extension, said gap decreasing in width as said curved portion of the inner edge of the hook-like extremity reaches an apex whereat it is joined with said inner edge of the outer leg extension, said outer leg extension carrying said first portion of said attention-attracting item, and said planar elongated section carrying said second portion of said attention-attracting item, such that when said planar elongated section is placed between the pages of the readable item, said upper curved hook-like extremity extends over the spine of the readable item such that said outer leg extension and said first portion of said attention-attracting item are external to the readable item and the spine of the readable item extends into said gap up to a width such that said curved extremity locks onto the spine of the readable item to thereby lock the bookmark in place during use, said card comprising a shape having a tab created by the separation of said card from said hook-like extremity.

2. The sheet of claim 1, wherein at least a part of said bookmark is a candy.

3. The sheet of claim 1, wherein said bookmark is adapted so as to either absorb or carry a smelling medium.

4. The sheet of claim 1, wherein at least one of said bookmark and said card is a coupon.

5. The sheet of claim 1, wherein at least one of said bookmark and said card is a greeting card.

6. The sheet of claim 1, wherein said attention-attracting item is pictorial and is co-planar with said elongated section.

7. The sheet of claim 1, comprising an advertising device, wherein said bookmark is configured so that said attention-attracting item is a first part of an advertising-type promotional message, and a second portion of said message appears on said card and on said elongated section.

8. A method for at least one of advertising and promoting, using the sheet of claim 1, wherein at least one of an advertising/promoting slogan and message is divided into two parts appearing on upper and lower sides of at least one of said bookmark and card, said parts being linked to each other.

* * * * *